United States Patent [19]

Richardson

[11] Patent Number: 5,054,787

[45] Date of Patent: Oct. 8, 1991

[54] PORTABLE VALIDATION UNIT FOR GAMING SYSTEM

[75] Inventor: John Richardson, San Diego, Calif.

[73] Assignee: Selectro-Vision, Ltd., San Diego, Calif.

[21] Appl. No.: 559,430

[22] Filed: Jul. 23, 1990

Related U.S. Application Data

[63] Continuation of Ser. No. 271,419, Nov. 10, 1988, abandoned, which is a continuation of Ser. No. 820,245, Jan. 17, 1986, abandoned.

[51] Int. Cl.[5] ..... A63F 3/06

[52] U.S. Cl. ..... 273/369; 273/138 A; 273/237; 273/454; 273/460; 364/410; 364/411; 364/412; 340/825.54; 340/323 R

[58] Field of Search ..... 273/269, 237, 238, 138 A, 273/1 E, 1 ES, 85 G; 364/410, 411, 412, 464.04; 340/825.54, 323 R

[56] References Cited

U.S. PATENT DOCUMENTS

| | | | |
|---|---|---|---|
| 4,072,930 | 2/1978 | Lucero et al. | 273/138 A |
| 4,283,709 | 8/1981 | Lucero et al. | 364/410 |
| 4,467,424 | 8/1984 | Hedges et al. | 273/138 A |
| 4,475,157 | 10/1984 | Bolan | 273/269 |
| 4,516,213 | 5/1985 | Gidden | 364/464.04 |
| 4,575,622 | 3/1986 | Pellegrini | 273/138 A |
| 4,636,951 | 1/1987 | Harlick | 273/DIG. 28 |
| 4,650,981 | 3/1987 | Forletta | 235/380 |
| 4,651,995 | 3/1987 | Henkel | 273/269 |
| 4,669,730 | 6/1987 | Small | 273/1 E |
| 4,747,600 | 5/1988 | Richardson | 273/237 |
| 4,768,151 | 8/1988 | Birenbaum et al. | 273/269 |

*Primary Examiner*—Edward M. Coven
*Attorney, Agent, or Firm*—Fitch, Even, Tabin & Flannery

[57] ABSTRACT

A portable validation unit for an electronic gaming system, particularly a BINGO system. The validation unit communicates through a serial data interface with a base station of the gaming system to receive a serial number defining a particular validation unit and corresponding employee, and further receives a validation code defining a particular gaming schedule. As the gaming schedule is played on electronic BINGO cards, wins of each game are validated by connecting a validation unit to an electronic card to ensure that the card has a matching validation code stored therein for the current gaming schedule and is indicating a winning sequence of called numbers. If there is no winning indication, then the validation unit sounds one of two audible tunes depending upon whether the validation codes match. In response to a matching validation code and win indication, the validation unit will sound another short recognizable audible tune indicating a win. If a BINGO card contains provision for more than one type of win, such as an instant BINGO, then different tunes are used to distinguish between win types. There is additionally provided circuitry for transferring a win record stored in a BINGO card to the validation unit during the validation process. Another aspect of the validation unit provides for sounding another distinguishable audible tune if the validation unti memory is full instead of transferring a record. At the end of the gaming schedule, the validation unit is adapted to transfer the win records to the base station during an audit process.

10 Claims, 7 Drawing Sheets

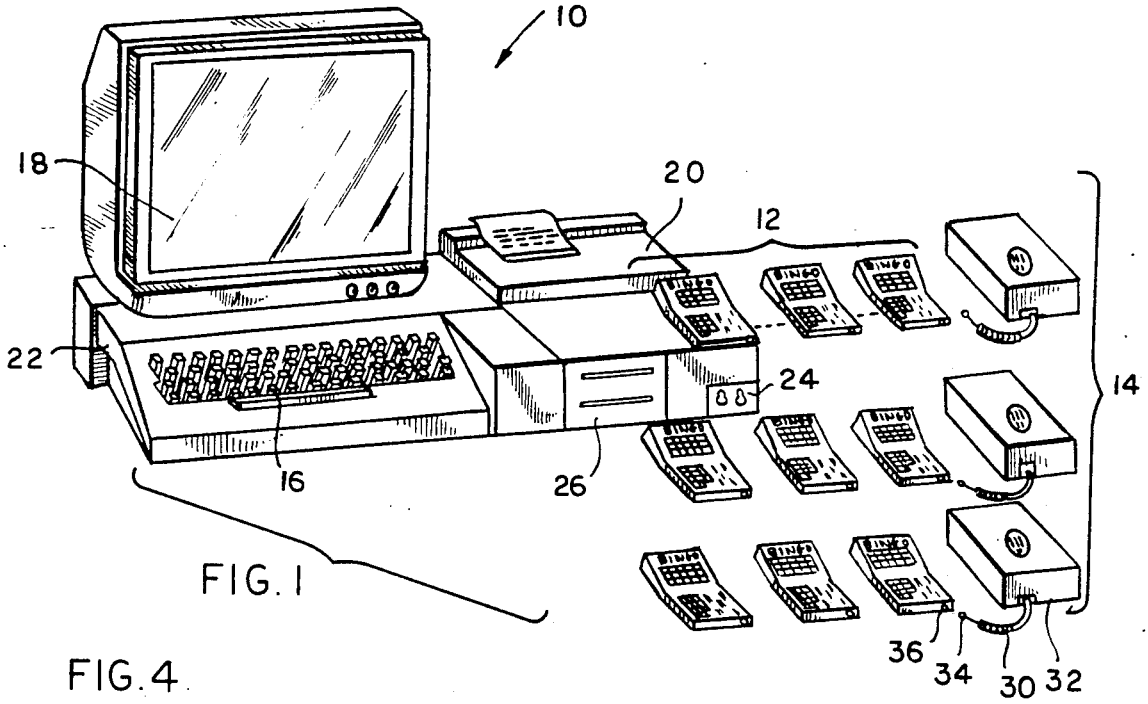
FIG. 1
FIG. 4
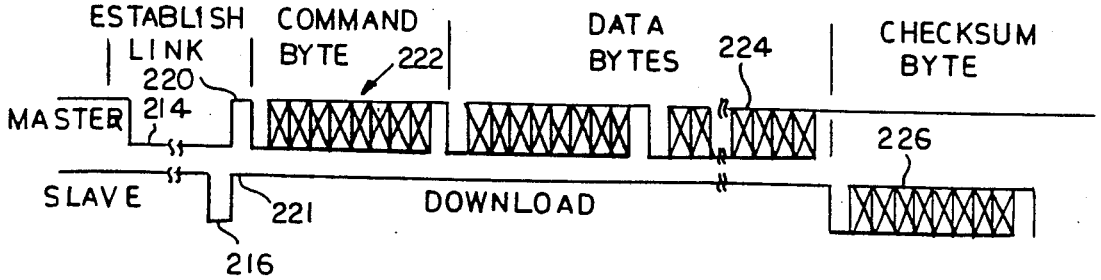
FIG. 5
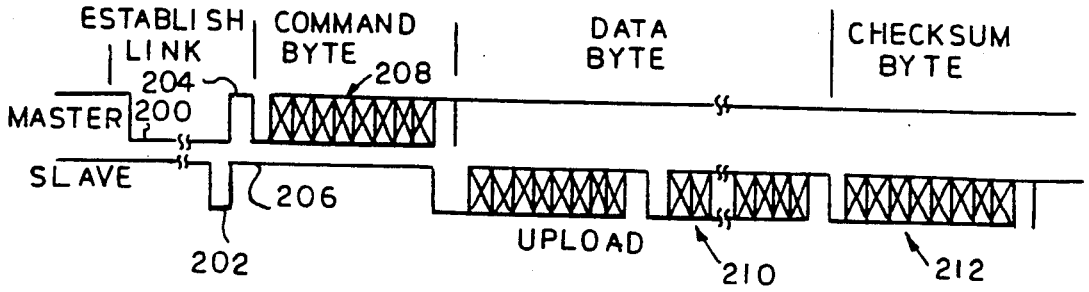

INITIALIZATION RECORD

| |
|---|
| ASSIGNMENT CODE 8 BYTES |
| VALIDATION CODE 16 BYTES |

HEADER RECORD

| |
|---|
| NO. OF RECORDS 3 BYTES |
| NULLS 4 BYTES |
| VU SERIAL NO. 8 BYTES |

WIN RECORD

| | |
|---|---|
| PLACE | CARD |
| WIN PATTERN | |
| GAME | LEVEL |
| EBC SERIAL NO. 8 BYTES | |

EBC RECORD

| |
|---|
| FREE SPACE |
| BAR LINE |
| CARD NUM |
| PATTERN NO. |
| GAME NO. |
| LEVEL NO. |
| EBC SERIAL NO. 8 BYTES |
| VALIDATION CODE 16 BYTES |
| REGULAR CARD |
| SPECIAL CARD |
| INSTANT BINGOS |

PORTABLE VALIDATION UNIT FOR GAMING SYSTEM

This application is a continuation of application Ser. No. 271,419 filed Nov. 10, 1988, now abandoned, which is a continuation of Ser. No. 820,458, filed Jan. 17, 1986, now abandoned.

The invention pertains generally to games of chance, such as BINGO and the like, and is more particularly directed to a portable validation unit used by a game operator to validate a win claim by a player with an electronic game card and to provide an audit record of payouts.

In BINGO and similar games of chance the basic elements of the game are a gaming board and a random number generating device. The gaming board can be a square array of numbers, usually a 5×5 array, with the centermost location being blank or termed a "free space". The game is played generally with either 75 or 90 numbers with each column in the array limited to only one-fifth of the numbers e.g., the first column numbers are taken from the Group 1 to 15 in the event 75 numbers are being selected from, 1 to 18 if it is 90; the second column numbers are taken from the Group 16 to 30 or 19 to 36, and so on. Further, duplicate numbers cannot appear on the gaming board.

When the game is being played, the game operator specifies a shape or pattern to be formed on the gaming board by randomly drawn numbers and then proceeds to call numbers at random between 1 and 75 or 90, whichever is appropriate. If a number called coincides with one on a player's board, the player marks the number in some fashion on his board. The object of the game is to be the first player to have a set of randomly called numbers coincide with the marked numbers on the player's board so as to form the specified shape or pattern.

The specified shape or pattern may be an X, T, L, a diagonal line, any five numbers horizontally or vertically, and so on. Several of these games, usually between twelve and eighteen, constitute a BINGO program or session which is played during the course of an evening over several hours The games are played consecutively and essentially without any major interruption except possibly for intermissions.

These games have long been played with paper boards which have a fixed printed numerical array. Players select from a large number of boards and, therefore, are unable to create and play with an array of their own choosing and determination. While some games have been played with blank paper boards that are filled in by the player writing in the numbers of the array desired, the cards are limited in size and can essentially only be used once since the player marks out the numbers called with an ink dauber or like means. This type of random array selection results in an inefficiency of operation for playing consecutive games on a minimum interruption basis.

This inefficiency affects not only the game operator, who must find and check a copy of the marked paper boards which are collected to avoid an unauthorized change in the numbers once the game has started, but also the player, who must prepare a new board prior to each game. These actions require time and detract from the desired even, and essentially uninterrupted, flow of a successful BINGO program. It is mainly for these reasons that the blank board approach has been used only for single games and then generally only the first game of the BINGO program.

Another important factor is to provide a gaming board which cannot be changed without the knowledge of the game operator, which provides an indication that it was acquired for use in the particular session being conducted, and which can be checked quickly in the event it displays a winning combination. Further, because each game during a normal BINGO program varies as far as the shape which the winning array may take, it is desirable for the player to have the shape of a winning array promptly displayed on his board and, further, to be provided with an automatic indication of when a match for that array has been achieved.

Recently, electronic hand sets have been developed to provide the advantages of a board where the player can easily select his own numbers, one which displays the shape of the array to be formed from the randomly called numbers, and further signals the player when a winning array has been achieved on his board. An electronic handset of this type is more fully described in U.S. Pat. No. 4,365,810 issued in the name of John Richardson on Dec. 28, 1982. Other advantageous electronic hand sets are disclosed in U.S. Pat. No. 4,798,387, entitled "Multiple Bingo Gaming Board" issued to John Richardson on Jan. 17, 1989; and U.S. Pat. No. 4,747,600, entitled "Electronic Gaming Board For Bingo", issued to John Richardson on May 31, 1988. The disclosures of Richardson are hereby expressly incorporated by reference herein.

Even with this improvement in game play, a win for an electronic hand set must be confirmed, which requires a validation of the numbers called to determine if they match the claimed winning pattern. With a typical 14 game program, there will be approximately 45 winning "BINGOs" to be confirmed. When a winning array has been achieved, a floor walker is alerted to provide a confirmation of the win. He does this by determining the pattern or format which is in play for a particular game, by determining the last number to be called in the winning sequence; and by perceiving which squares on the gaming card are involved in the format. After these initial steps have been accomplished, the actual confirmation of a winning BINGO is done by repeating back to the caller all numbers which appear in the winning pattern or format. As the floor worker repeats the numbers to the caller, they are checked against the caller's master board to make certain that such numbers were called in the first place. If the win is verified, then the player receives his payout and the next game is started.

However, with an electronic handset there is additionally a need to verify whether the card is programmed for the present session and whether the electronically determined win is in fact valid. These tasks are complicated by the fact that an electronic handset may contain more than one winning card or have more than one winning pattern.

Another problem which confronts the operator when using electronic gaming cards, or regular paper cards for that matter, is the lack of available auditing procedures. Because a winning player is paid in cash at the time of his win, if some inconsistency develops in either the amount paid for one game or the total amount paid over all of the games, there is no practical means for correcting the error.

SUMMARY OF THE INVENTION

The invention solves the validation and auditing problems for a BINGO gaming session, or the like, by providing a portable validation unit which can be used by a game operator to validate a claim by a player using an electronic handset and to further store data concerning that win for later auditing purposes.

The validation unit comprises a microprocessor based communications and storage device which can alternatively establish a communications link with an electronic handset or a system base station. When first connected to the system base station, the validation unit is loaded with a serial number identifying an employee of the operator to whom the validation unit is assigned and the specific validation unit. A validation code for the particular gaming session is additionally stored in the device.

Thereafter, the validation unit can be interfaced with any of a plurality of electronic BINGO cards used during a gaming session to determine if they contain a matching validation code. If the validation codes match, then one type of indication is generated by the validation unit which the employee will recognize as a valid card indication. If the validation codes do not match, then another indication will be generated by the validation unit which is recognized by the employee as an invalid card indication.

During a communications link, the electronic BINGO card is commanded to transfer information in a record form to the validation unit for storage and collection, if a winning condition is found. If the storage area of the validation unit is full and cannot store an additional record, then an indication of that condition is generated to the employee so that another validation unit may be used to record the win. The winning condition is additionally verified by the validation unit providing the employee with an indication recognized as a win. More than one type of distinguishable indication may be generated for different types of winning conditions.

In the preferred embodiment of the validation unit, the indications of status for a valid or invalid electronic BINGO card, the unavailability of storage area, and the confirmation of a win and type of win are provided by an audible annunciator. The audible indications are produced by a tone generator which generates a different tone or series of tones (tune) which can be associated with the specific status of the card.

Another aspect of the invention provides a means for conserving battery power for the hand held validation unit. During the communications link to the system base station at initialization, the validation unit is turned on by a logic level provided by the connection. If the validation unit receives an assignment code and a validation code, then it will latch its power supply on for the expected gaming session. Otherwise, the validation unit will turn off its power supply until a true initialization of the device occurs. The validation unit will remain powered on validate wins of the electronic BINGO cards until linked with the system base station at the end of a gaming session. The validation unit at that time recognizes a turn off command by the system base station and performs a power down operation in response thereto.

The ability to turn the validation unit on and off by the system base station provides a significant security advantage for the game operator. Accounting data cannot be entered into a validation unit until the start of a gaming session and then only by a specialized sequence. Further, after the gaming session and the downloading of the accounting data by a validation unit to the system base station, the data is erased from each unit by shutting its power supply off. The gaming operator thereby maintains control of the accounting data of a gaming session and protects against its alteration by unauthorized personnel.

These and other objects, features, and aspects of the invention will become apparent upon reading the following detailed description taken in conjunction with the attached drawings wherein:

BRIEF DESCRIPTION OF THE DRAWINGS

FIG. 1 is a pictorial representation of an electronic gaming system including a validation unit which is constructed in accordance with the invention;

FIG. 4 is a pictorial representation of the waveforms for serial data communications for downloading information into the validation unit illustrated in FIGS. 1 and 2;

FIG. 5 is a pictorial representation of the waveforms for serial data communications for uploading information from the validation unit or from the electronic BINGO cards illustrated in FIGS. 1 and 2;

DETAILED DESCRIPTION OF THE PREFERRED EMBODIMENTS

Figures 2, 2A, 2B, 2C, 2D:
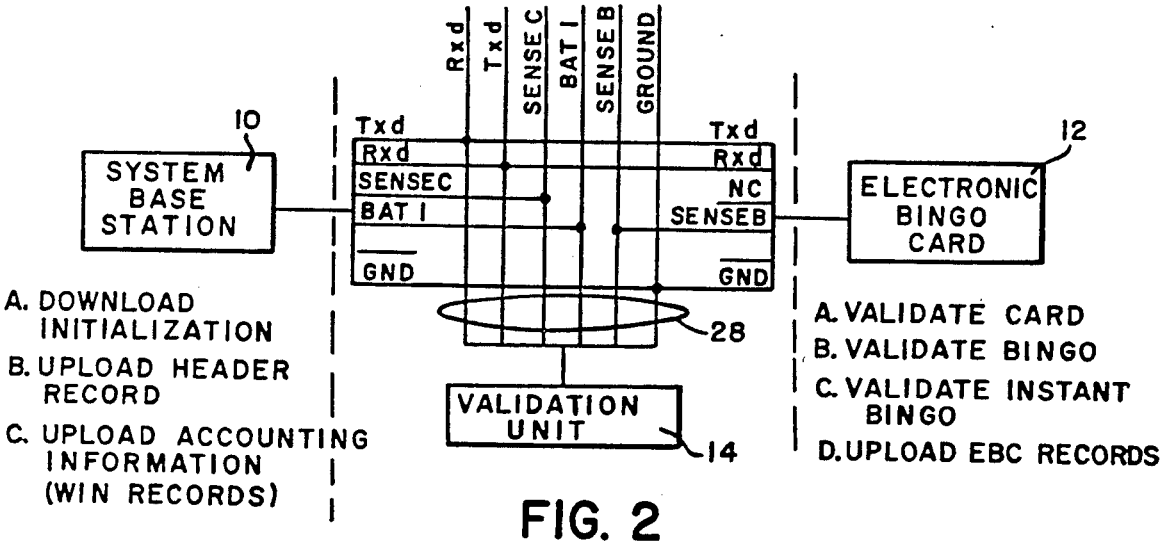
FIG. 2 is a block diagram view of the validation unit illustrated in FIG. 1 showing its electrical connection to either a system base station or an electronic BINGO card of the system illustrated in FIG. 1.
FIGS. 2A–2D are pictorial representations of the data packages which are transferred between the validation unit and the system base station or the electronic BINGO card.

In FIG. 1 there is shown an electronic BINGO system including a validation unit constructed in accordance with the invention. The electronic BINGO system comprises three major components including a system base station 10, a plurality of electronic BINGO 12, and a plurality of validation units 14. The system base station 10 includes a keyboard 16, video monitor 18, printer 20, computer 22, communications cradle 24, and disk drive 26 wherein such elements are connected as a data processing system.

The system base station 10 is microprocessor controlled and functions as a point of sale terminal and accounting or auditing center for the system. The system base station 10 uses the communications cradle unit 24 to connect to any of the electronic handsets 12 or any of the validation units 14 such that data can be transferred between the devices.

The electronic handsets 12 are used by players in place of paper cards and markers which traditionally have been used in the game of BINGO. These handsets can be the gaming handsets more fully described in the previously referenced Richardson patent or those described in the referenced copending Richardson applications. The system base station 10 is more fully described in copending application Ser. No. 820, 521 entitled "Automatic Gaming System" by Richardson.

In general, each electronic handset 12 is in turn connected through cradle 24 to the system base station 10 during an initialization step such that it is downloaded with a gaming schedule so that a player may use it in a series of games termed a gaming session. The electronic handsets 12 are also downloaded with an assignment code and a validation code for a particular gaming session. As the numbers of a particular game are called, the player enters those numbers into the electronic handset 12 to determine if they match any numbers recorded on one of the BINGO cards contained therein. A particular game in the session is played until one of the electronic handsets signals, usually audibly and by a visual indicator, that the game has been won.

The validation units 14 are additionally initialized by connection to the cradle 24 and receive an assignment code and the same validation code as the handsets 12 for the particular gaming session. When a player scores a BINGO, or other type of winning combination, one of the validation units 14 is used to verify that the win was legitimate. At the same time information specific to the win is recorded within the validation unit and later these stored data records are uploaded to the system base station 10 via the cradle 24.

As more fully detailed in FIG. 2, the validation unit 14 communicates with either the system base station 10 or the electronic handsets 12 through a serial communications interface including an adaptor plug 28. The adaptor plug 28 is a six pin female telephone type jack which is available for connection with the other devices. A coiled cable 30 with two male plug ends 32, 34 (FIG. 1) extends from the jack to connect the validation unit 14 to the other two devices in the system. The pins of the adaptor plug 28 form a serial data transmit line TxD, a serial data receive line RxD, two sense lines-sense B, sense C, a low battery detection line BAT1, and ground. These pins connect to similarly labeled pins in the cradle 24 and adaptor plug 36 of the handsets 12.

When an operator needs to validate an electronic handset 12. he plugs the cable end 34 into an adaptor plug 36 in the bottom of a handset 12 and then listens for an audible annunciation by the validation unit 14. There are several distinguishable audible annunciations available from the validation unit 14, each indicating a different status for the electronic handset 12.

The validation unit 14 receives from the system base station 10 when first powered on, an assignment code of eight bytes in the form of an ASCII string and a validation code of sixteen bytes in the form of ASCII string (FIG. 2A). The validation code defines the particular game schedule or session in play and can be changed as often as the operator desires. The identical validation code is also stored in each of the electronic handsets 12 such that it can be matched with the one stored in the validation unit 14. The assignment code is a number given by the system base station 10 to the validation unit 14 describing the particular unit and the employee to whom it is entrusted for the session.

After the validation of a winning handset 12, an EBC record (FIG. 2D) stored in that handset relating to the winning combination is transferred to the validation unit 14 and stored as a win record (FIG. 2C). Thereafter, a plurality of the win records (FIG. 2C) may be uploaded to the system base station 10 for auditing purposes by two operations that upload a header record (FIG. 2B) and upload the win (FIG. 2C) records. The header record is a count kept by the validation unit 14 of the number of win records it has stored and also includes the assignment code of the device and a byte forming the checksum of the information sent. A command to upload the win record causes the validation unit 14 to transfer one of its stored records about a win. The win record of an electronic handset 12 contains information as to the place of the win, which card (BINGO array) the win occurred on, the win pattern, and game number. Further, the information indicates the level of the win and the serial number of the winning handset 12. Operationally, when the validation unit 14 is connected to the electronic handsets 12, it is used to validate the handset, validate either a regular or instant BINGO, and upload one or more the EBC records. When the validation unit 14 is connected to the system base station 10, it is used to receive the initlalization record, or to upload the header records or win records.

Figure 3:
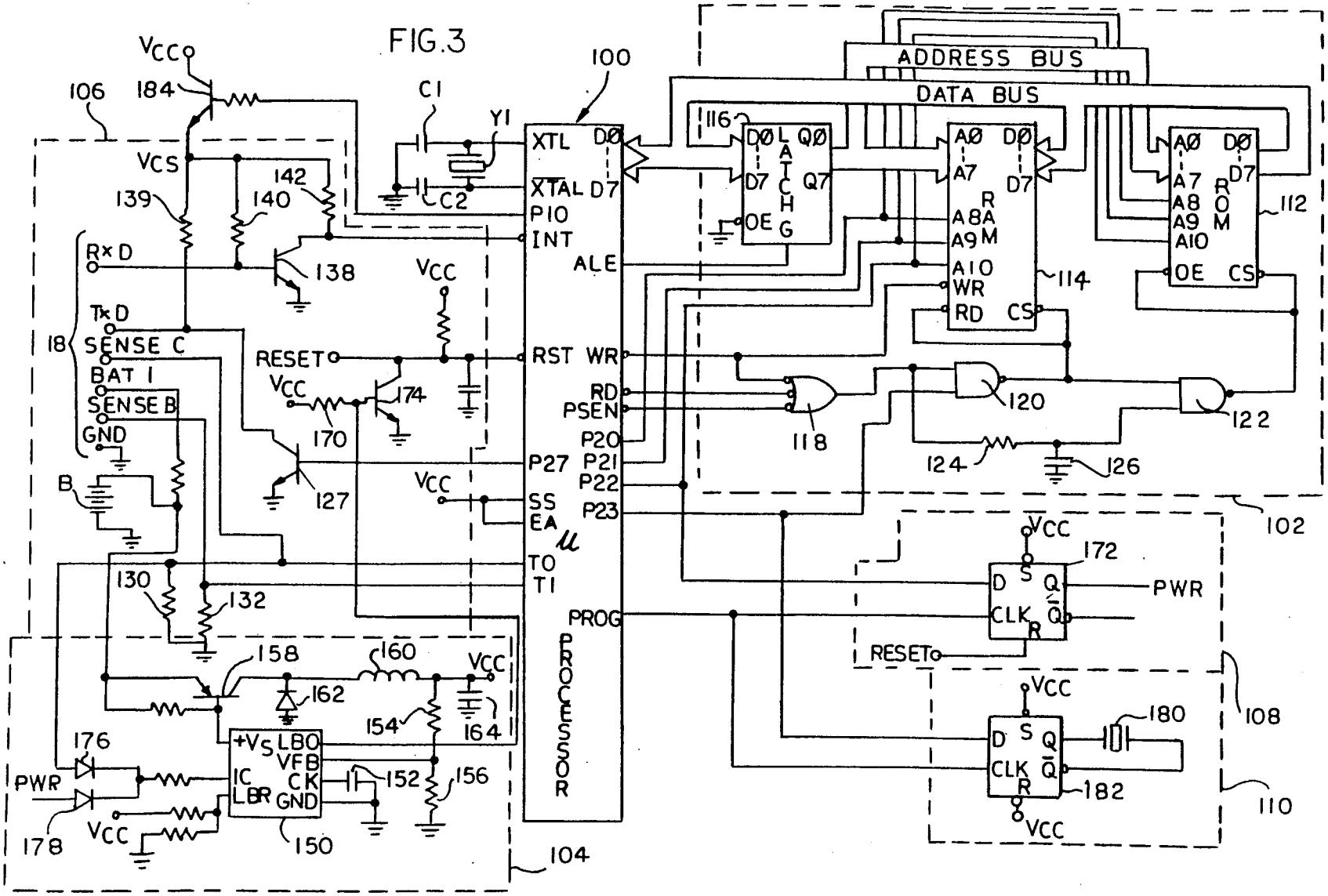
FIG. 3 is a detailed electrical schematic diagram of the circuitry comprising the validation unit illustrated in FIGS. 1 and 2.

FIG. 3 shows a detailed electrical schematic of a validation unit 14 which generally comprises a microprocessor 100, memory and memory control 102, power supply 104, communication interface 106, power supply bistable 108, and an audio annunciator 110.

The microprocessor 100 is a standard, single chip microcomputer having data/address bus D0–D7, bidirectional input and output ports P10, P20–P23, P27, and a control bus WR, RD, PSEN, PROG, and ALE. Further, the microprocessor 100 has pins for handling interrupts INT and resets RST along with timed logic levels T0, T1. While the microprocessor 100 could be any type of single chip microcomputer, preferably, the device is a 80C49 microprocessor manufactured by the Intel Corporation of Santa Clara, Calif. The pin designations shown will be of that device and are more fully described in the operating manual for the Intel 80C49. A single chip microcomputer of this type includes internally a central processing unit, 128 bytes of random access memory and 16 8-bit registers R0–R15. Further included are an 8 word by 16-bit stack and 96 bytes of general purpose RAM and as an option, 2K bytes of ROM.

Communications for the microprocessor 100 with peripheral devices is carried out through the 8-bit data/address bus D0–D7, the four memory and I/O control lines, and the general and special purpose I/O lines. The microprocessor 100 is driven by a 6 MHz. crystal oscillator Y1 connected between its terminals XTAL and *XTAL. Each terminal of the crystal Y1 is further connected to a capacitor C1, C2, respectively, whose other terminal is grounded The external access pin EA and the single step pin SS for microprocessor 100 are not used and, therefore, are tied to a high logic level Vcc.

Normally, a read only memory 112 of the memory 102 will contain the control program for the microprocessor 100. Instructions are transferred from the ROM 112 via its data output pins D0–D7 which are connected to the data bus and thereafter, to the data port pins D0–D7 of the microprocessor 100. The address for the ROM 112 is generated by the address port pins D0–D7 of the microprocessor 100 in addition to the port 2 pins P20–P22 for address lines A8, A9, and A10. An address byte from the data port pins D0–D7 is strobed into an address latch 116 with an alternate logic enable signal from pin ALE. Similar connections between the data bus and the address bus for a random access memory 114 are provided by the system. At the beginning of each memory cycle, the microprocessor 100 places the low 8-bits of the memory address on the data bus and then strobes them into the latch 116 with the ALE signal The high address bits A8–A10 have previously been set by selection of logic levels on port pins P20–P22. For the remainder of the memory cycle the data bus carries data from the RAM 14 or ROM 112 to the microprocessor 100 or from the microprocessor to the RAM.

Control for the direction of the data flow, and which memory that the data is read from or written into, is controlled by the write control line WR, read control line RD, the program sequence pin PSEN, and port 2 pin 23. These signals are connected to the control inputs of the random access memory 114 and the read only memory 112 via three memory control logic gates 118, 120, and 122 which have their outputs connected, respectively, to the read and chip select inputs RD, CS of the random access memory 114 and to the output enable and chip select inputs OE, CS of the ROM 112. The write control line WR of the microprocessor 100 is also directly connected to the write input WR of the random access memory 114.

When the microprocessor 100 initiates a fetch operation for instructions or data from an external memory, it prepares the address bus as described above and pulls combinations of the signals PSEN, RD or WR low depending upon whether a read or write operation is to take place. Gate 118 acting as a negative true, three input NOR gate produces a high logic level when any of these three signals are low. The output of gate 118 indicates that one of the external memory devices is being accessed. The NAND gate 120 produces a low level logic signal to select a read of the random access memory 114 when the output signal from gate 118 is a high logic level and pin P23 of the microprocessor 100 is at a high logic level. The write output WR is used directly to select a write operation for RAM 114.

The NAND gate 122 generates a low logic level signal to select a read of the read only memory 112 when the output of gate 118 is a high logic level and the output of the RAM select gate 120 is a high logic level, indicating that external memory is being accessed but not RAM. A resistor 124 and a capacitor 126 form a RC delay to prevent a race condition on the read only memory select pins during the brief interval when pin P23 and the output of gate 118 are high but the RAM select signal from gate 120 has not yet made a transition to a low logic level due to propagation delay.

The validation unit 14 communicates with two devices external to itself, namely the system base station 10 and the electronic handsets 12, through communication interface 106. The communication interface 106 is designed to consume an absolute minimum of power, especially when idle, and be reasonably fast. The communication interface 106 uses an asynchronous communications protocol with the addition of a special handshaking routine to establish communications. The general communications protocol is byte serial communications with one start bit, eight data bits (no parity), and one stop bit at a data rate of 4800 baud. Serial data is transmitted via the transmit line TxD and serial data is received via the receive line RxD.

When the validation unit 14 is not connected to any other device, the microprocessor inputs pins T0 and T1 are held at a low logic level by pull down resistors 130 and 132, respectively. These pins are used to indicate which of the two external devices are connected to the validation unit 14. The pin T0 is assigned to the system base station 10 via the sense C line while pin T1 is assigned to the electronic handsets 12 via the sense B line.

A different communications format is used depending on which device the microprocessor 100 is communicating with. When the validation unit 14 is connected to an electronic handset 12, it initiates any communication by generating commands as a master unit. When the validation unit 14 is connected to the system base station 10, it acts as the slave unit and waits for the system base station 10 to initiate the communication. The microprocessor level sensing pins T0 and T1 are connected to the sense C and sense B outputs, respectively of the connector 18. The sense C line has a voltage applied to it, if the system base station 10 is connected, and the sense B terminal has a voltage applied to it, if an electronic handset 12 is connected to the validation unit 14.

As seen in FIG. 5, when the validation unit 14 detects a high logic level on T1, it will establish a communications link with an electronic handset 12. The link is accomplished by the validation unit 14 beginning the communications by placing a zero (break) on its transmit line TxD. The microprocessor 100 accomplishes this operation by applying a logic one to the port 2 pin P27 causing transistor 127 to conduct thereby pulling the transmit line TxD to ground (level 200 in FIG. 5). The validation unit 14 will then wait for the electronic handset 12 to respond with a zero to the receive line RxD, shown at 202 in FIG. 5. A low logic level on the RxD line will cause the transistor 138 to stop conducting because of its bias connections with resistors 140 and 142. This high level will end an interrupt to the INT terminal of the microprocessor 100 indicating the electronic handset 12 has replied. Thereafter, the microprocessor 100 responds by setting the data output line TxD high again at 204 and waits for the electronic handset 12 to do the same to the RxD line at 206. Once this has been accomplished, the link is established and data communications can take place.

The validation unit 14 will transmit a one byte command 208 to the electronic handset 12 requesting that it transmit its stored information about the present card in play and a win if any. The electronic handset 12 transmits a block of data 210 to the validation unit 14 in byte serial format and terminates the transmission with a checksum 212. This communication protocol more particularly illustrated in FIG. 5 is termed an upload operation from an electronic handset 12 to a validation unit 14. The information uploaded is an EBC record as illustrated in FIG. 2D.

Conversely, when a validation unit 14 detects a high logic level on pin T0 of the microprocessor 100, this is an indication that it is connected to the system base station 10. With the system base station 10, the validation unit 14 does not initiate communications but waits for the base station to do so. The commands can be either to upload information or prepare for a download of information.

In the manner illustrated in FIG. 4, the system base station 10 places a logic zero on the input data line RxD of the validation unit 14 shown at 214. After pin T0 has detected a high logic level during connection, the microprocessor 100 continuously checks its INT line to detect a zero condition on the RxD line. When a logic zero on the RxD line appears, the validation unit 14 responds with a logic level zero on its output data line TxD at 216. The handshake is completed when the system base station 10 detects the logic zero, and in response thereto, returns the RxD line to a high logic level at 220. The system base station 10 then waits for the validation unit 14 to sense the return of the RxD line to a high level. The validation unit 14 then brings its output data line TxD at 220 back to a high logic level at 221. This procedure establishes the communications link.

After the communications link has been established, the microprocessor 100 waits to receive a command from the system base station 10 and will idle waiting for the command as long as T0 is held high. If the T0 goes low, then the link will have to be reestablished before any communications can occur. The system base station 10 thereafter, sends a command byte 222 to the validation unit 14 to request a certain operation.

A command byte is an ASCII numeral from the set 2, 5, 6, and 7 (all other numbers are ignored) specifying one of four commands as follows:

"2"; Download Assignment and Validation Code
"5"; Power Down
"6"; Upload Header Record
"7"; Upload Next Record After receiving the command byte, the validation unit 14 executes one of the four commanded operations depending upon the value of the byte. If the command byte is a "2", the validation unit prepares to receive (download) a block of data 224 from the system base station 10. The data block which is downloaded is shown in FIG. 2A. If the command byte is a "6" or "7", the validation unit 14 will transmit (upload) a block of data as previously described with reference to FIG. 5. The data blocks which are uploaded are shown in FIG. 2B, 2C, respectively. If the command byte is a "5" the validation unit will power down and turn itself off. Any other command byte value is ignored. After these actions are completed, the validation unit 14 breaks the communications link thereby requiring the link to be reestablished for further communication to occur.

Following the data block transfers regardless of whether data went to or from the validation unit 14, a checksum byte 212 or 226 is transmitted to the system base station 10. The checksum is the arithmetic sum of all the bytes transmitted after the command byte in modulo 256. For data transmitted from the validation unit 14 (upload), the system base station 10 must match this checksum to the one it calculates while receiving the data. If they match, the transfer was good and, if not, the system base station 10 is responsible to reestablish the communications link and reissue the command to upload until a good transfer is achieved. For data transmitted to the validation unit 14 (download), the checksum must equal zero as a check byte will be included in each block of data to make the checksum equal zero if the transfer is valid. If the checksum transmitted to the system base station 10 is not zero, then it is incumbent upon the base station 10 to reestablish the communications link and reissue the command to download until a good transfer is achieved.

The power supply circuitry 104 and the power supply bistable 108 will now be more fully described with respect to FIG. 3. The circuitry of the validation unit 14 is a group of semiconductor integrated circuit devices requiring a supply voltage Vcc of approximately +5V. The entire validation unit 14 is powered by a single +9V battery B producing +9V when fully charged and no lower than about +6V when nearing depletion. The +5V supply voltage Vcc for the validation unit 14 is generated by a step-down switching voltage regulator 150 which, for example, can be an Intel Corp. integrated circuit device with a part number RC4193.

An external capacitor 152 serves as the timing element of an oscillator internal to the regulator 150. By pumping current into and out of the capacitor, a triangular waveform is produced with a 50% duty cycle. The output voltage Vcc of the regulator 150 is divided down by resistors 154 and 156 before being fed back to the input VFB of the regulator. The voltage at the feedback input VFB is compared against an internally generated reference of 1.3V.

If the feedback voltage is less than the reference, then PNP shunt output transistor 158 is turned on for a half cycle of the internal oscillator. While transistor 158 is conducting, current flows from battery B through inductor 160 causing energy to be stored in its magnetic field. When the oscillator switches to the other half cycle, the output transistor 158 is shut off. The current, however, continues to flow through the inductor 160 causing the voltage at the collector of transistor 158 to drop rapidly until a rectifier 162 is forward biased. Current flows through the rectifier 162 charging an output filter capacitor 164 until the energy stored in the inductor 160 is expended. The output voltage is regulated to 1.3V* (R154+R156)/R156 which approximates 5V.

The regulator 150 must be enabled or it will remain turned off and not provide power for the IC chips. To enable the regulator 150 requires current to be sourced to its input IC. When this current is removed, the regulator 150 shuts down drawing almost no current from battery B and causing Vcc to decay. As the output voltage Vcc drops, the voltage at input LBR of regulator 150 also drops in accordance therewith. The input LBR is the low battery reference pin and when the voltage there is less than 1.2V, the output LBD of the regulator 150 goes to a high logic level. Via resistor 170, this high logic level turns transistor 174 into conduction thereby resetting the microprocessor 100. This is done to ensure that the microprocessor 100 does not accidentally turn itself on due to erratic operation during a power down cycle.

The validation unit 14 has no on/off switch but is turned on and off by controlling the operating current to the input IC of regulator 150. The diodes 176 and 178 form a logical wired OR circuit for providing current to the input IC of the regulator 150. The validation unit 14 can turn itself off under program control by means of a D type power bistable 172 connected to diode 178. The regulator 150 is initially turned on by a linkage to the system base station 10. The source of current from the system base station 10 through diode 176 comes from the sense C input of the communications connector 18. Otherwise, current through diode 178 can be provided by the output Q of the bistable 172. The bistable 172 is set or reset by the software via the output pin P22 and the auxiliary clock line PROG. A one on the output of the bistable 172 turns the regulator 150 on and a zero output turns it off via diode 178.

The bistable 172 is loaded with a zero during power on initialization by the reset mechanism and only after the validation unit 14 receives the assignment code and validation the system base station 10 is it loaded with a one. Until that time, the connection to the base station 10 maintains the power supply on via diode 176. If the initialization occurs, the validation unit 14 will stay powered on after being disconnected from the system base station 10 and if the initialization does not occur, the unit 14 shuts off after being disconnected. If the system base station 10 sends a power off command, then the bistable 172 is loaded with a zero value so the validation unit 14 will turn off as soon as it is disconnected from the system base station 10.

The validation unit 14 further provides control over the power supply to the communications interface 106. An NPN switching transistor 184 is disposed between the power supply voltage Vcc and the pull up and bias resistors 139, 140, and 142 of receive amplifier transistor 138 and transmit amplifier transistor 127. Control of the transistor 184 will turn the communications power on and off and is provided by the program control of the logic level on microprocessor 100 port pin P10 connected to the transistor base.

These operations provide power savings and security for the use of the validation unit 14. Until connected to the base station 10, the validation unit will be powered down to save energy. This mode further prevents unauthorized personnel from entering any data therein which might affect the audit records or play of a gaming session. Only when the system base station 10 is initially connected is the validation unit 14 then turned on. The power on condition is not maintained if the unit is not initialized correctly providing another level of security. During its power on condition, the communications power supply is switched on and off so that it is used only when connected to an electronic handset 12 or the base station 10. After win records have been uploaded to the system base station 10 the validation unit 14 is turned off on command. This operation prevents information from being lost during a gaming session by an accidental shut down but also assures that the data collected will be erased after it is uploaded to the system base station 10. Further, as discussed above, the shut down operation conserves energy until further use.

The validation unit 14 uses audible tones from the annunciator 110 to indicate the status of an electronic handset 12 during the validation process. The device used to generate the sonic energy needed for a tone is a piezoelectric bender element 180. The element 180 is a high efficiency, high impedance, low power audio transducer which can be driven by two alternating logic levels In the illustrated embodiment, it is driven by the complimentary outputs of a D type bistable 182. In this manner, the bender element 180 sees a signal with a magnitude of approximately twice the power supply voltage Vcc or about 10 VAC. Because the driving signal is a square wave, a tone from the bender element 180 is rich in harmonics and quite distinctive. The microprocessor 100 under program control toggles the bistable 182 at various frequency rates to produce different desired tones.

Figure 6:
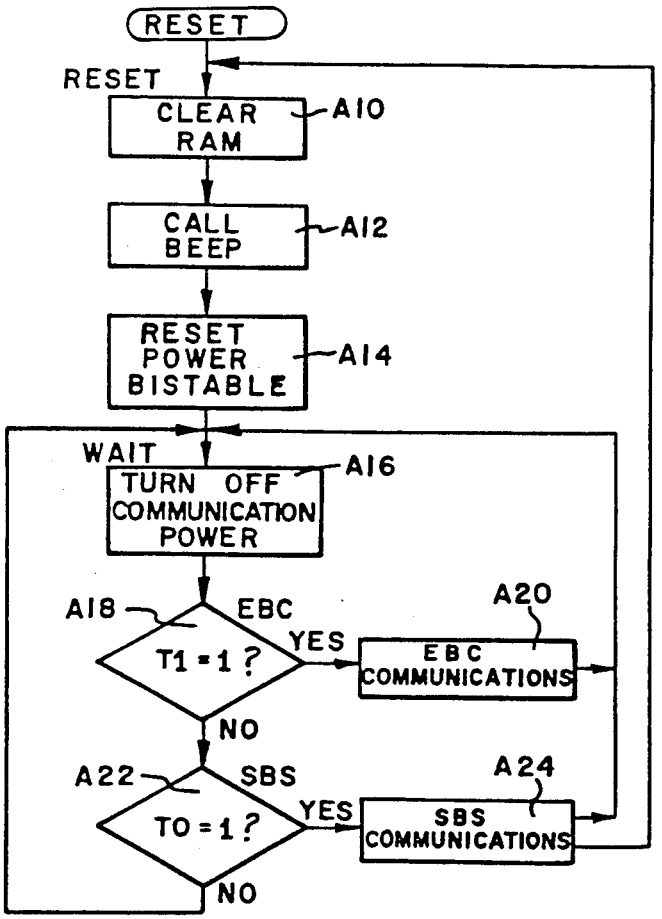
FIG. 6 is a system flow chart of the control program which regulates the processes and signals of the microprocessor illustrated in FIG. 3.

The system software which controls the validation unit 14 is more fully shown in a system block diagram in FIG. 6. The system software is stored in the read only memory 112 in FIG. 3 and acts as an operational control for the functions of the microprocessor 100 and a system control. When the microprocessor 100 is reset for any reason, such as a low battery or the power regulator 150 being turned off, the storage area, RAM 114, which generally contains records for the validation unit 14 is cleared This operation is functionally shown in block A10 and causes the validation unit to start up with a clear scratch pad and ready for data input Further, for security reasons once the validation unit 14 is commanded to power down, the records contained therein are no longer available to unauthorized personnel.

Next the program calls a subroutine labeled BEEP in block A12 which produces a single, short tone via the tone generator 110 and piezoelectric bender 180. The BEEP is an audio indication to a floor worker or other employee of the gaming operator that the microprocessor 100 has gone through a reset operation. If the unit for some reason becomes locked into a reset loop, the tone generator 110 would continue beeping to notify of that condition. Next, the software resets the power bistable 172 as indicated in block A14 by setting a zero on pin P22 and strobing the bistable 172 with the PROG signal. For a reset condition bistable 172 is generally directly reset by the low logic level on the collector of transistor 174. However, if noise or some other condition has set the bistable 172, this operation is used to make sure that the validation unit 14 is powered down.

After the reset loop has been completed, the validation unit 14 enters a waiting loop starting at the address WAIT, where it idles until the device is plugged into either the system base station 10 or an electronic handset 12 for communications. This waiting or idle loop comprises blocks A16, A18, and A22 where the communications power is turned off by bringing pin P10 of the microprocessor 100 to a low logic level thereby turning off PNP transistor 184. Turning off transistor 184 disconnects power voltage Vcs to the pull up and bias resistors of transistors 138 and 127 comprising the receive amplifier and transmit amplifier, respectively. This produces a great savings of power even when the power regulator 150 is maintained in an active condition.

The program, thereafter, causes the microprocessor 100 to test in turn the T0 and T1 pins for a high logic level. A high logic level on either pin is an indication that one of the other devices of the system is connected to the validation unit 14. If T1 is a high logic level, then it is an electronic handset 12 that is connected to the connector 18 while if T0 is a one, then it is the system base station 10 that has been connected. The connection of the system base station 10 through the diode 176 enables the regulator 150 via the IC input. Thus, the power regulator 150 will be on even though the power supply bistable 172 is still in a reset state.

For a logic level of one on the T1 input, the microprocessor 100 will take an affirmative branch from block A18 and transfer control of the program to block A20 where an electronic handset communications routine is performed. In general, the electronic handset communications are to validate a card and a win and then to load a record of a win into the validation unit 14. When the electronic handset communications routine has been performed, the validation unit 14 will go back into the idle loop by transferring control to the address labeled WAIT. This loop then will be continued until another communications operation is requested.

If, on the other hand, a logic level of one is sensed on the T0 input of the microprocessor 100, the program transfers control from block A22 to block A24 wherein a system base station communications routine is executed. The system base station communications routine generally provides one of four functions. First, the system base station communications routine can download the validation code and assignment code to the microprocessor 100 for storage in RAM 114. This enables the validation unit 14 to match the stored validation code with an identical validation code loaded into each electronic handset 12 for a particular gaming schedule. The second function the system base station communications routine may perform is to upload a record header which indicates the serial number of the validation unit 14, and the number of win records which the validation unit has stored from its communications with individual electronic handsets 12. The third function performed by the validation unit 14 in response to the system base station communications routine is to upload a record of a win from the RAM memory 114 to the system base station 10. This is the reverse of the process where the electronic handsets 12 transfer their win records to the validation unit 14 for storage. The fourth function of the system base station communications routine is to provide a method for powering down the microprocessor 100 to an off state. In this operation the power supply bistable 172 is turned off in response to a command from the system base station 10.

In response to any one of the first three functions, the system base station communications routine will perform the commanded operation and thereafter, return the validation unit 14 to the idle loop in block A16. The command which causes the power down of the validation unit 14 will cause a transfer back to the start of the program or the location labeled RESET. In this sequence the validation unit 14 will go through a reset operation before entering the idle loop, thus, initializing the unit for the next gaming schedule.

Figure 7:
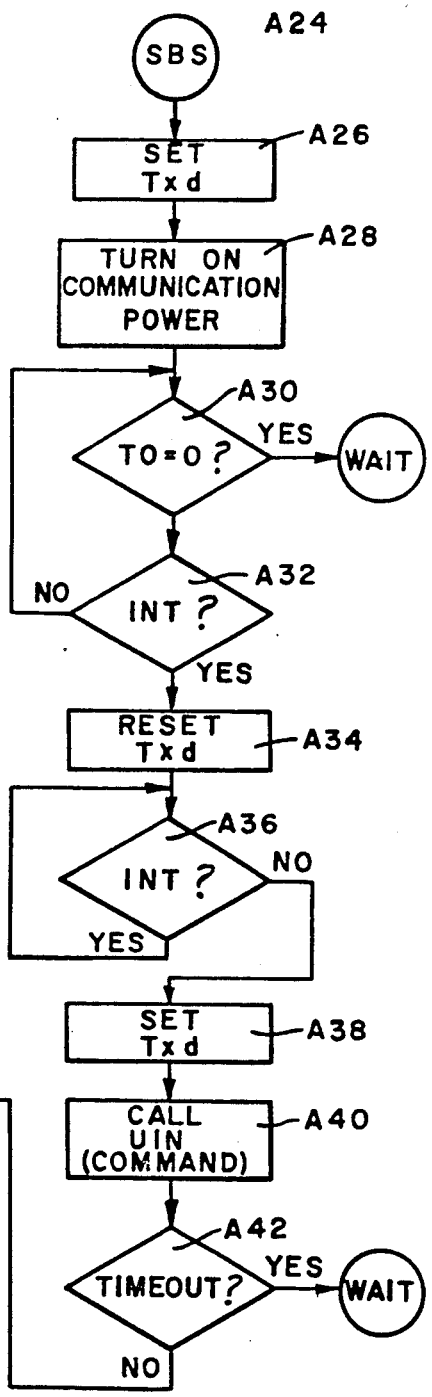
FIG. 7 is a more detailed flow chart of the system base station communications routine illustrated in FIG. 6.
Figure 7:
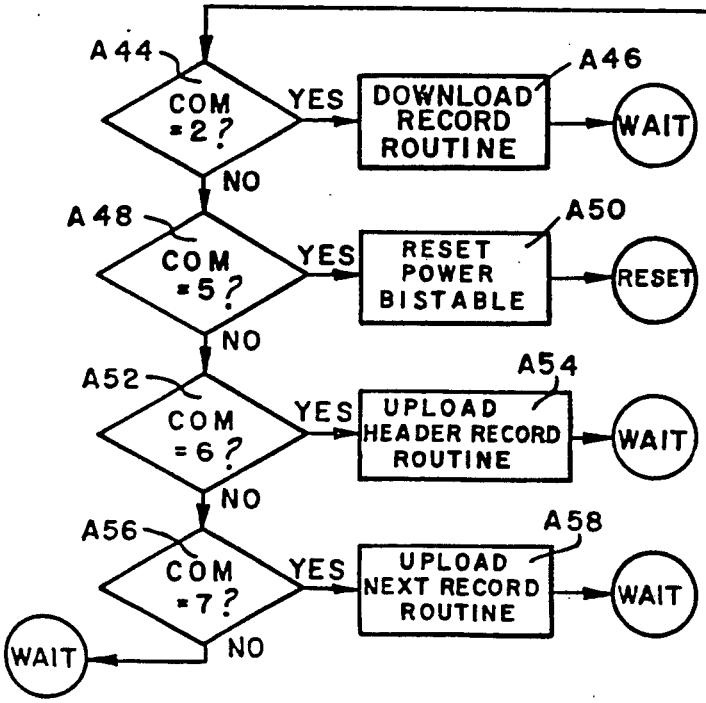

FIG. 7 is a detailed flow chart of the system base station communications routine which begins at block A26. In this block the microprocessor 100 realizes it is connected to the system base station 10 because the program has been entered from block A22 and, therefore, the logic level input to T0 was found to be a logic level of one. This means communications with the system base station 10 will take place shortly, but the validation unit 14 in this protocol is a slave unit under the command of the system base station 10. Therefore, the system base station 10 must start the communications. Thus, the validation unit 14 sets its TxD output in block A26 to one indicating that it is ready to begin the communications protocol handshake. Thereafter, in block A28 the routine turns on the communications power by providing a high logic level on pin P10 causing transistor 184 to conduct thereby allowing the receive and transmit amplifiers 138 and 127, respectively to become active.

In block A30, A32, the microprocessor 100 enters a waiting loop until the system base station 10 provides an interrupt with a low logic level on the RxD input. As long as the system base station 10 maintains a high logic level on pin T0, the validation unit 14 will wait for the communications. If, however, during the time that the loop is being executed, the system base station 10 decides to abort the communications, it can send the validation unit 14 back into a waiting state by lowering the high logic level on pin T0. This change is sensed by block A30 and transfers control back to the main idle loop (WAIT) of FIG. 6.

Normally, the system base station 10 will continue the communications and lower the interrupt line producing a transfer from block A32 to block A34. In reply to the initial interrupt, the microprocessor 100 then will lower its transmit line TxD and wait for the interrupt line RxD to go to a high logic level again. This test is performed by block A36 and until the interrupt is cleared from the INT pin of the microprocessor 100, the loop will be maintained. After the system base station 10 has cleared the interrupt, the microprocessor 100 will again reply by bringing the TxD line to a high logic level in block A38. This handshaking completes the linkage and communications can now begin.

The microprocessor 100, thereafter, expects a command to follow within a preset interval. Therefore, an input routine UIN which acts as an asynchronous serial data receiver at the interrupt pin is called in block A40. The subroutine UIN returns with the input command in one of the registers of the microprocessor 100. The command allows the validation unit 14 to determine which operation the system base station 10 wants the unit to complete. If the command is not received within a preset period of time or there are other errors in the communications, then in block A42 a time out indication will occur and the validation unit 14 will go back to the waiting or idle loop in FIG. 6.

If a command was received and the data is acceptable, then the command is decoded in a path beginning with block A44 and continuing to block A56. Block A44 determines whether the command is a 2, block A48 determines whether the command is a 5, block A52 determines whether the command is a 6, and block A56 determines whether the command is a 7. If none of these commands are found, then the validation unit 14 will transfer control back to the idle loop in FIG. 6. A command 2 causes validation unit 14 to transfer control to block A46 where a download record routine is called to perform the function of storing the assignment code and validation code for the device.

A command of 5 will transfer control from block A48 to block A50 where the power bistable 172 is reset and the validation unit 14 powered down until the next startup operation. This is actually analogous to an off switch, which is software operated by the system base station 10. If the command is a 6, then a routine in block A54 is called to upload the header record so the system base station 10 may determine how many records have been stored into the validation unit 14. In addition, the system base station 10 may cause each record to be transferred to it by giving the command 7 which causes transfer of control to block A58 and an upload next record routine to be called. The software exits from block A46, A54, and A58 are to the idle loop in FIG. 6 so the next command from the system base station 10 or a connection to an electronic BINGO card 12 can be handled. For the power down operation from block A50, the exit is to the location RESET such that the RAM can be cleared in block A10 to produce an initialized validation unit 14 ready for the next startup.

Figure 8:
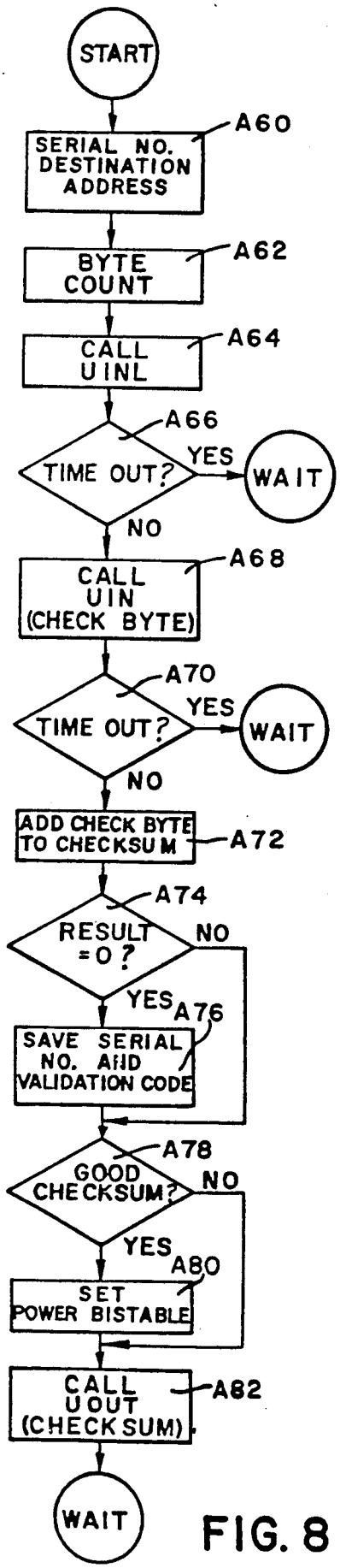
FIG. 8 is a detailed flow chart of the download record routine illustrated in FIG. 7.

FIG. 8 illustrates block A46 of the previous figure and is a detailed flow chart of the download record routine. The initial operation of this routine in block A60 causes the microprocessor 100 to calculate a destination address for the communications that the validation unit 14 recognizes will be coming from the system base station 10. This address is the beginning of a temporary storage block of the RAM 114 which is long enough to store the assignment code and validation code to be sent. Next, in block A62, the byte count of this information is determined and passed to a subroutine UINL in block A64 which receives the number of bytes indicated in the byte count and stores them at the destination address calculated in block A60. The two pieces of data that the validation unit 14 receives are eight bytes of a serial number assigned to the validation unit (assignment code) and sixteen bytes of a validation code defining the particular gaming schedule (FIG. 2A).

In block A66 after the input of this data, a time out indication is checked for in block A66. If there was a data error in the input, then a time out will cause an affirmative branch from block A66 and transfer the program back to the idle loop in FIG. 6. This will disconnect the communications between the validation unit 14 and the system base station 10. It will be the responsibility of the base station 10 to reinitiate the communications if it so desires.

Next, the subroutine UIN is called in block A68 to receive a single data byte from the system base station 10 comprising the check byte for the block of data just transferred. If a time out has occurred on the transfer of this byte, then again the communication link is severed and the validation unit 14 goes back to an idle state. However, if the check byte is received validly, it is added to the checksum in block A72 to determine the result of that sum. Because the subroutine UINL in block A64 has been calculating a checksum during the input of bytes during the communications, the addition should result in zero. This result is tested for in block A74 and a nonzero checksum indicates that a communications error has taken place.

Upon an error being sensed, the negative branch of block A74 transfers control to block A78 where the checksum result is again tested. Since the test was negative in block A74, the result will again be negative in block A78 and control transferred to block A82. This causes the validation unit 14 to call the subroutine UOUT to output the checksum byte to the system base station 10. A nonzero check byte received at the system base station 10 will indicate that the communications have caused an error. It is then the responsibility of the base station 10 to reestablish the communications link and transmit the data once again. Once the checksum has been output to the system base station 10 from block A82, the system exits to the idle state to await another communications operation.

Alternatively, if the initial communication was valid, then an affirmative branch from block A74 causes the program to operate on block A76 and save the serial number and validation code from the data block transferred. Thereafter, the checksum is again tested in block A78 and an affirmative branch will take the program to block A80. In block A80, since communications were good and the serial number and validation code have been stored, the validation unit 14 should be made operable and, therefore, the power bistable 172 is set latching power on. Thus, after good communications and the storage of the serial number and the validation code, the power bistable 172 will maintain the validation unit 14 operational even after the connector 18 is disconnected. Thereafter, the program exits normally through block A82 to the idle state, outputting the good checksum (zero) to the system base station 10 before the exit.

Figure 9:
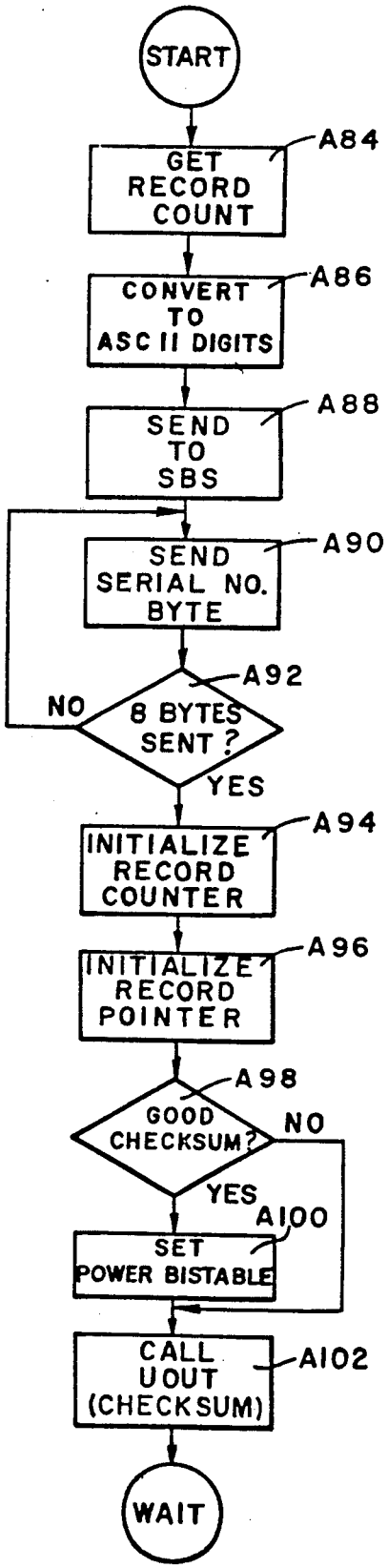
FIG. 9 is a detailed flow chart of the upload header record routine illustrated in FIG. 7.

FIG. 9 is a detailed flow chart of the upload header record routine designated block A54 in FIG. 7. The routine begins in block A84 by fetching the record count from the RAM 114 where it is stored. The record count is stored in RAM 114 binary code so that it will only take one byte of memory. To upload it to the system base station 10, the record count must first be converted to ASCII digits in block A86 before being sent to the system base station 10 in block A88. Thereafter, in blocks A90 and A92 a loop is formed to send the serial number stored in RAM 114, byte by byte, to the system base station 10. This serial number is the assignment code of the validation unit 14 downloaded at the beginning of the scheduling program. Thereafter, a record counter which will be decremented as the system base station 10 uploads each win record is initialized to the record count in block A94. A record pointer which will be used to address each record as they are uploaded is initialized in block A96 by making it point to the initial address of the first record in the RAM memory 114.

A good communications link is then checked for by determining whether the checksum calculated is zero in block A98. If the checksum is not zero, it is sent out immediately to the system base station 10 by calling the subroutine UOUT in block A102. If the checksum is good, the power bistable 172 is set in block A100 before sending out the checksum to the system base station. Upon the completion of the upload header record routine, the validation unit 14 exits to the idle loop whose location is WAIT.

Figure 10:
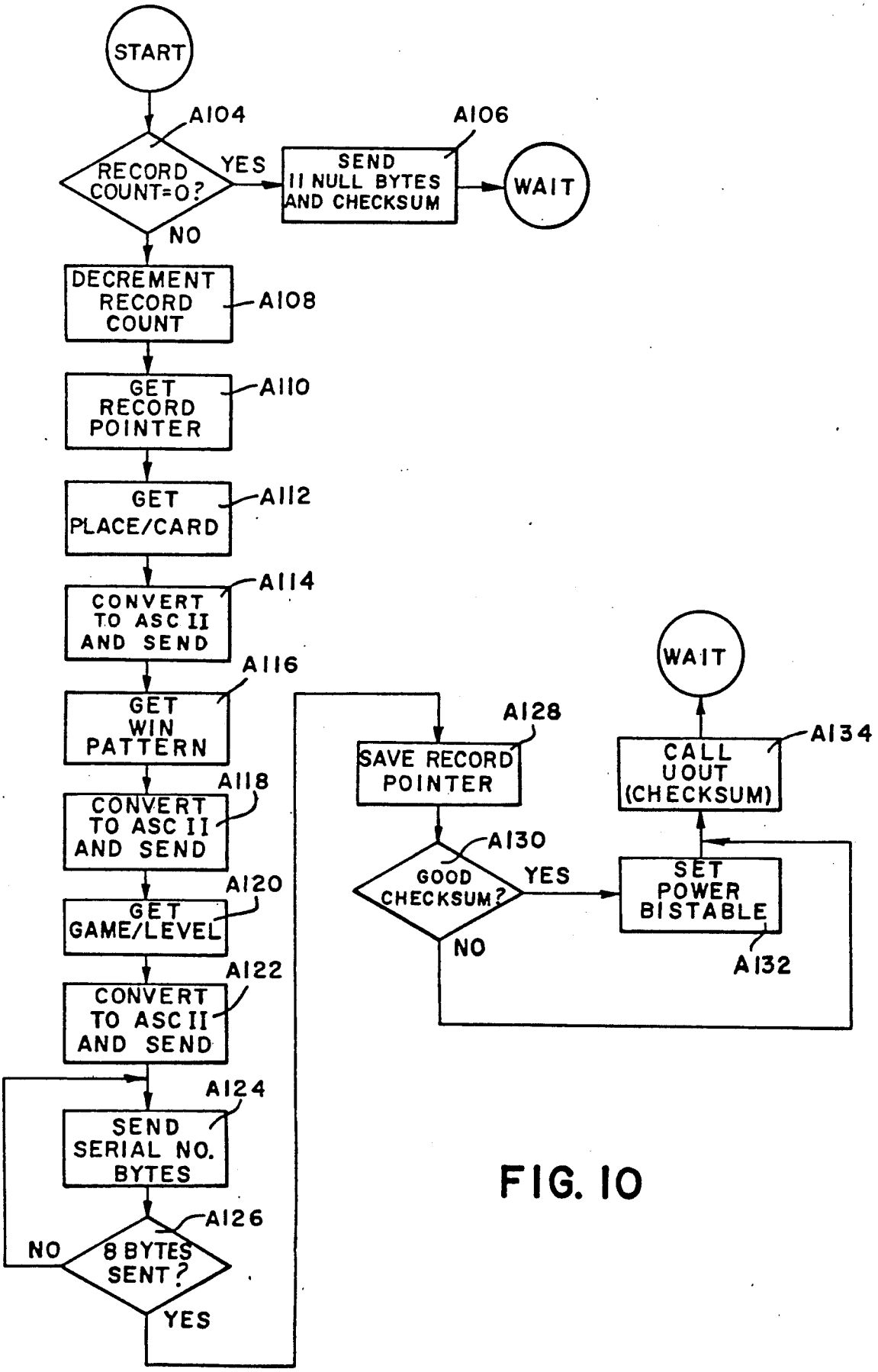
FIG. 10 is a detailed flow chart of the upload next record routine illustrated in FIG. 7.

FIG. 10 is a detailed flow chart of the upload next record routine A56 of FIG. 7. The routine begins in block 104 by reading a storage location where the number of records stored in the validation unit is located. If this record count is zero, meaning that no records have been stored, then control is transferred to block A106 where a null record of 11 null bytes and a checksum are sent to the system base station 10. The program then exits to the idle loop.

If there are any records stored in the validation unit 14, then in block A108 the record count is decremented to indicate that one record has been sent to the system base station 10. Thereafter, the record pointer which indicates the first address of the present record is fetched in block A10. From that address, the first byte of the record is placed in a register in block A112. The first byte of the record is comprised of a first nibble indicating the place of a win and the second nibble indicates the card on which the win occurred. Once the place/card byte is in a register, it is converted to two ASCII characters in block A114 and sent to the system base station 10. Next, the record pointer is incremented to address the next byte of the record which contains the win pattern. This byte is fetched in block A116. The byte is converted to ASCII in block A118 and sent to the system base station 10. Similarly, in block A120 the next game/level byte of the record is fetched, converted to ASCII, and sent to the system base station 10 in block A122.

Subsequently, the serial number of the particular electronic handset that the win occurred on is sent to the system base station 10 in blocks A124 and A126. These two blocks form a loop which transmits the eight bytes of the electronic handsets serial number to the base station 10 a single byte at a time. Thereafter, the record pointer is saved in block A128 as it now points to the next record in the validation unit. A test of the checksum for the eleven byte record sent to the system base station 10 is made in block A130 and, thereafter, output in block A134 to the system base station. If the checksum is good, the power bistable 172 is set in block A132 but if the checksum is invalid, the power bistable 172 is bypassed.

Figure 11:
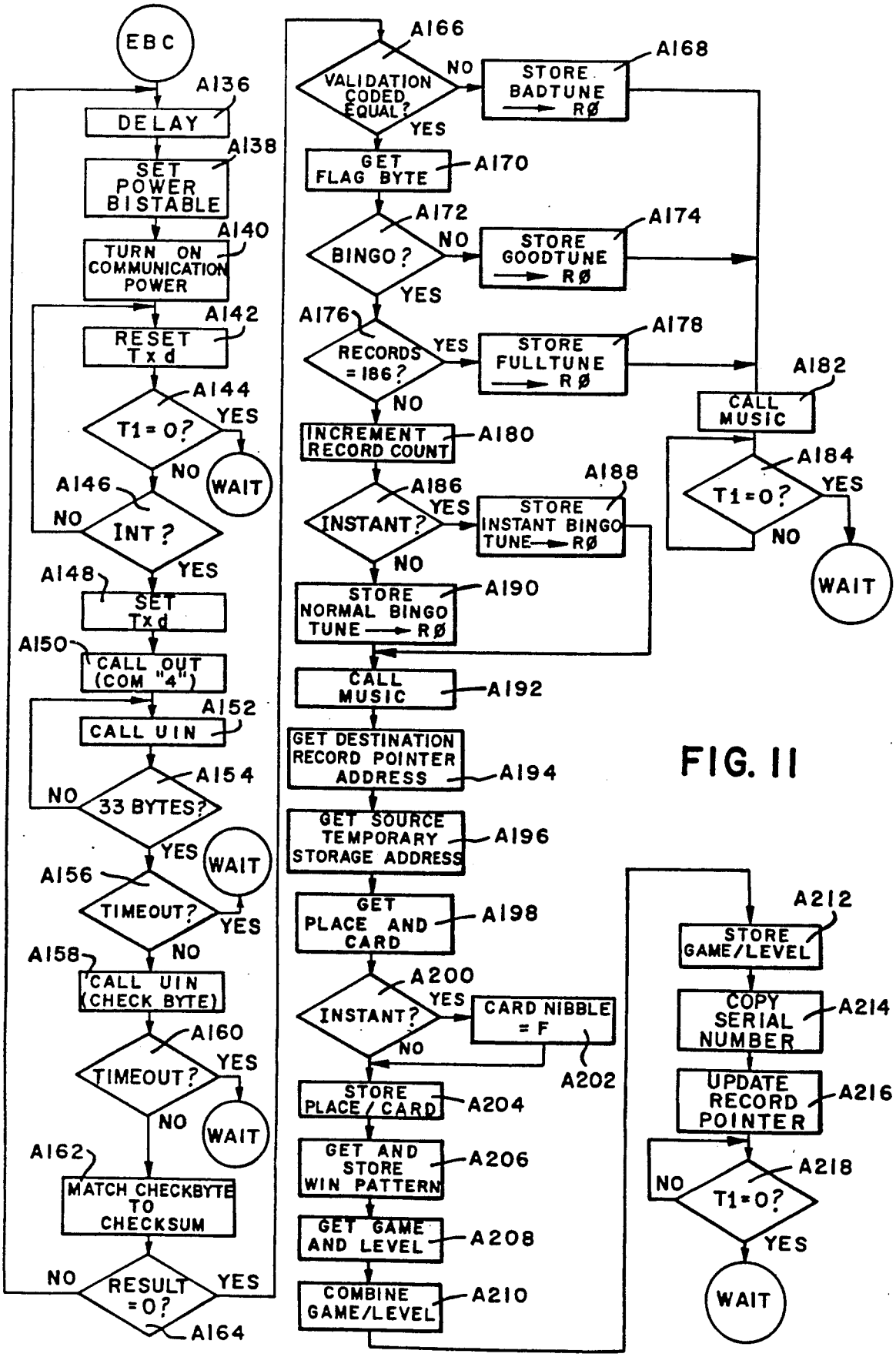
FIG. 11 is a detailed flow chart illustrating the electronic BINGO card communications routine illustrated in FIG. 6.

FIG. 11 is a detailed flow chart of the electronic handset communications routine A20 which begins in block A136 with a small delay. Next in blocks A138 and A140, the power bistable 172 and the transistor 184 are enabled by setting pins P22 and P10 of microprocessor 100 to a high logic level, respectively. Once the power bistable 172 has been set and the communication power turned on, then the communications link can be established between the validation unit 14 and an electronic handset 12. This path begins in block A142 by the validation unit 14 pulling its TxD line to a low logic level signaling a break or start of communications. Next in block A144, the logic level pin T1 is tested to determine if it remains at a high logic level. If not, the communications link will be broken immediately and the validation unit 14 will return to the idle loop in FIG. 6.

However, if the communications link is still to be established the program advances to block A146 where it waits for an interrupt, or a low logic level reply, on the RxD line from the electronic handset 12. The loop is completed by transferring control back to block A142 until the electronic handset 12 replies with a low logic level. At that time, the program advances to block A148 where the validation unit 14 places a zero on pin 27 of the microprocessor 100, thereby setting the transmission line TxD to a high level. The communications link has now been established between the validation unit 14 and the electronic handset 12.

Thereafter, the validation unit 14 will issue a command 4 to the electronic handset 12 via the subroutine UOUT which will cause the electronic handset card to upload information to the validation unit. The command which is sent to the electronic handset in block A150 is a single byte uploading communications with the validation unit 14.

In block A152 the subroutine UIN is called to perform a byte by byte transfer of 33 bytes in an input loop for an EBC record as shown in FIG. 2D. The loop of blocks A152, A154 continues until all 33 bytes have been received and a time out error is checked for in block A156. If a time out error is found in block A156, then the communications link will be broken and the system will exit to an idle state in FIG. 6.

It is the responsibility of the validation unit 14 to rerequest or try to establish the communications link once more if an error is found. If the high logic level still remains on pin T1 of microprocessor 100, the communications link will be established automatically through the same path. The communications link and the transfer of the information will be requested as long as the two devices remain connected and until an error free transfer takes place. After the communications have resulted in a good data transfer, the subroutine UIN is called in block A158 to input another single byte. This is the check byte from the electronic handset 12. Again a time out is tested for in block A160 and the idle state entered if a data error is encountered in reading the byte from the electronic handset 12.

Thereafter, the program advances to block A162 where the check byte is matched with a checksum in a register which has been accumulating a summation of all the 33 input bytes. The result should be zero, if the check byte is to match the checksum, and such test is accomplished in block A164. If the result is not zero, indicating an error, the program transfers control immediately to block A136 and the start of the communications routine.

Thus, as long as an electronic handset 12 is connected to a validation unit 14, the microprocessor 100 under the program control will continually attempt to get a valid transfer of the 33 data bytes of a record. These 33 bytes are stored in a temporary storage area in the internal RAM of the microprocessor 100 and later stored in the RAM 114 for the transfer to the system base station 10.

After an EBC record has been input validly, the program will advance to block A166 where the validation code which was stored at the initialization of the validation unit 14 is tested against the validation code input from the electronic handset 12. This validation code will be changed for every gaming sequence or session to assure that the electronic handsets 12 used are those which were passed out and paid for in this particular session. Because there is no way of knowing what the validation code will be before the game cards are passed out and the validation unit 14 is initialized, this method assures integrity of the gaming schedule and electronic handsets.

A match of the validation codes causes an advance of the routine to block A170. However, if the validation codes do not match, the negative branch from block A166 transfers the control to block A168 where an address labeled BADTUNE is stored in register R0. The address BADTUNE is the beginning of a series of tones in a recognizable sequence of a tune which can be played by a subroutine MUSIC which is later called at block A182. The MUSIC subroutine will use the address as the start of a data block and determine a number of bytes of the tune from data stored in the block. After the number of bytes in the tune, the data block comprises alternating frequency words and duty cycle words. Successive tones are stored one after another such that the subroutine MUSIC can play a tune by producing the prescribed frequencies on pin P23 of the microprocessor 100 (FIG. 3) which causes the bistable 182 to modulate the piezoelectric bender 180 with that waveform. Each tone is played in succession until the MUSIC routine finishes the particular tune.

Thus, if the validation codes are not equal, a bad tune is played by the path through blocks A168 and A182. Thereafter, the validation unit waits for a floor worker to disconnect the invalid electronic handset 12 from the validation unit 14. A disconnection is indicated in block A184 by the logic level input T1 making a transition to a low logic level. After the electronic handset 12 has been disconnected, the affirmative branch from block A184 transfers control of the program back to the idle loop in FIG. 6.

However, if the validation codes are matched in block A166, then the annunciator byte (BAR LINE) from the electronic handset 12 is read from the temporary memory in block A170. The bits in the annunciator byte will determine whether or not a BINGO has been recorded on the electronic handset 12 and this condition is tested for in block A172. If there is no BINGO, then the program path is to block A174 to merely indicate that the electronic handset is good but no BINGO has been validated. Block A174 accomplishes this by storing the address of a short distinctive tune labeled GOODTUNE in register R0.

If the validation codes match and a BINGO is found, then the path of the program is to block A176 where a record counter is tested to determine whether it equals 186. This number is equal to the maximum number of win records that may be stored in the random access memory 114 by the validation unit 14. If the memory is full, then control is transferred to block A178 where the address of a short distinctive musical tune labeled FULLTUNE is stored in R0. Thereafter, the subroutine MUSIC is called in block A182 to play the tune to indicate to the floor worker that the RAM 114 of the validation unit 14 is full. Thus, for validating the particular electronic handset 12 the floor worker will obtain another validation unit 14 and store the win record in the other unit. The exit from the FULLTUNE routine is through block A184 by waiting for the validation unit 14 to be disconnected from the electronic handset 12. Thereafter, the validation unit 14 will exit back into its idle state.

If the memory is not full, the validation codes match, and a BINGO is indicated, then in block A180 the program will increment the memory location containing the number of records previously stored in RAM 114. Thereafter, in block A186 the flag byte is again tested to determine whether the BINGO is a normal BINGO or an instant BINGO. If the win was an instant BINGO, an address of a distinctive tune indicating that condition is stored in register R0 in block A188, while if the win was a normal BINGO than the address of a distinctive tune indicating that that condition is stored in register R0 in block A190. Thereafter, the condition present is sounded to the floor worker by calling the subroutine MUSIC in block A192.

The validation unit 14 will now take the win record which is stored in temporary memory and transfer it to a storage area in the RAM 114 for later uploading to the system base station 10. The path which accomplishes this begins at block A194 by obtaining the destination of the record which is termed the record pointer address. The next step as indicated in block A196, is to obtain the source address of the beginning of the record in temporary storage. In block A198, the place and the card indications of the win are obtained from temporary storage and combined into one byte. Subsequently, in block A200 the flag byte is again tested to determine whether the BINGO was a regular or instant BINGO. If the BINGO was an instant BINGO, then the card nibble of the place/card byte formed in block A198 is replaced by a distinctive indicator such as the hexadecimal F in block A202. Thereafter, the place/card byte is stored in the record memory in block A204.

The win pattern is taken from the temporary storage and transferred to the record storage in block A206. The game and level bytes from the temporary storage are then obtained in block A208 and combined into one byte in block A210. The new game/level byte is then stored in record memory in block A212. Thereafter, the electronic handset serial number stored in temporary storage is copied to the record memory in block A214. To complete the operation, the record pointer is updated to point to the next address of the RAM memory 114 where a record can be stored. This record pointer address is then stored until the next win record is to be stored. To complete the routine, the program enters a loop in block A218 waiting for the electronic 12 to be disconnected from the validation unit 14. The validation unit 14 senses the disconnect when the sense input T1 makes a transition to a low level. After disconnection, the validation unit 14 enters the idle state until the next communication.

While a preferred embodiment of the invention has been illustrated, it will be obvious to those skilled in the art that various modifications and changes may be made thereto without departing from the spirit and scope of the invention as defined in the appended claims.

What is claimed is:

1. A portable validation unit for use in a bingo gaming system having a system base station with a bidirectional data communications port and a plurality of electronic handsets each with a bidirectional data communications port, said system base station providing base station security information including a validation code which uniquely identifies a specific bingo game and assignment codes each of which uniquely identifies one of said electronic handsets of one of said validation units; each of said handsets providing handset security information including a validation code which uniquely identifies a specific bingo game and an assignment code which uniquely identifies the respective said electronic handset; each of said handsets further allowing play on at least one bingo card electronically stored in said handset and further providing auditing information including any win card data indicative of a specific bingo card on which a win occurred, said validation unit comprising:

a bidirectional data communications port;

interfacing means for selectively connecting said bidirectional data communications port of said validation unit alternatively to one of (a) said bidirectional data communications port of said system base station and (b) said bidirectional data communications port of one of said plurality of electronic handsets;

memory means for receiving through said interfacing means said base station security information provided by said system base station and for storing said received base station security information;

memory means for receiving through said interfacing means handset security information provided by a said electronic handset and for storing said received handset security information;

security checking means for determining whether an electronic handset is designated for use during a specific bingo game said security checking means including:

means for comparing said validation code received from a respective said electronic handset with said validation code received from said system base station, and first indicator means for providing a handset validation indication if said validation code received from said electronic handset corresponds to said validation code received from said system base station, whereby said first indicator means reveals whether or not the respective electronic handset is designated for use during a specific bingo game; and memory means for receiving through said interfacing means auditing information provided by respective said electronic handsets and for storing said received auditing information for subsequent analysis.

2. A portable validation unit as set forth in claim 1 wherein said auditing information further includes at least one of (a) pattern shape data indicative of the shape of a winning pattern on bingo card, and (b) win pattern data indicative of the position of a winning pattern on a respective bingo card.

3. A portable validation unit as set forth in claim 2 wherein said auditing information further includes win level data indicative of the level of said winning pattern, such that each said win level requires matching a unique win pattern.

4. A portable validation unit as set forth in claim 1 further including:

device identification means for determining whether the device connected to said interfacing means is a system base station or an electronic handset;

communication initiating means for initiating communications when said validation unit is determined to be connected to said electronic handset through said interfacing means; and responding means for responding to communication when said validation unit is determined to be connected to said system base station through said interfacing means.

5. A portable validation unit as defined in claim 4 wherein said communication initiating means issues commands to said electronic handset to upload information to said validation unit and said responding means receives commands from said system base station to upload information from said system base station.

6. A portable validation unit as defined in claim 1 further including win code memory means for storing at least one win code in memory, wherein a respective said electronic handset provides a game condition indication to said validation unit through said interfacing means in response to a command to upload information which is communicated by said validation unit through said interfacing means to said electronic handset, said game condition indication being indicative of a winding pattern on a respective bingo card and the specific bingo card on which a win occurred;

said validation unit further including:

comparison means for comparing said game condition indication with said at least one win code stored in said memory means of said validation unit;

signal generation means for generating a win signal if the comparison indicates the game condition indication corresponds to one of said at least one stored win code; and indicator means responsive to said win signal for providing a win validation indication that the respective said electronic handset contains a winning game condition indication.

7. A portable validation unit as defined in claim 6 wherein:

said at least one stored win code comprises a plurality of stored win co said signal generation means generates one of a plurality of win signals, each of which corresponds to one of said win codes if the comparison indicates said game condition indication received from said electronic handset corresponds to any of said win codes stored in said validation unit; and said indicator means provides one of a plurality of win validation indications, each of which corresponds to one of said win signals.

8. A portable validation unit as defined in claim 1 wherein said auditing information received from a respective said electronic handset is stored in the form of a data record, said validation unit further including:

a record counter for counting the total number of individual data records received from said plurality of electronic handsets, said record counter having a maximum count number;

means for incrementing said record counter in response to the receipt of each of said data records from said electronic handsets through said interfacing means;

means for comparing a current count in said record counter with said maximum count number;

means for generating a full signal if the comparison indicates said current count in said record counter equals said maximum count number; and indicator means responsive to said full signal for providing an indication that said memory means is full.

9. A portable validation unit as defined in claim 1 wherein:

said base station security information memory means, said handset security information memory means, said auditing information memory means, said interfacing means, and said security checking means collectively include microprocessor means for control and data processing;

said bidirectional port is connected to said microprocessor means;

said portable validation unit further comprises a power supply connected to said microprocessor means; and said interfacing means comprises:

a serial data transmission line;

a transmission amplifier having an input connected to said bidirectional port, and an output connected to said serial data transmission line;

a receiver amplifier having an input connected to said serial data transmission line, and an output connected to said bidirectional port;

first switching means controlled by said microprocessor means for connecting said power supply to said receiver amplifier; and second switching means controlled by said microprocessor means for connecting said power supply to said transmission amplifier.

10. A portable validation unit as set forth in claim 9 wherein said base station further provides switching signals and said power supply comprises a battery power source, and wherein:

said microprocessor means receives said switching signals through said interfacing means and is responsive to said switching signals to selectively control said first and second switching means;

said power supply includes means responsive to said switching signals for connecting or disconnecting said power supply from the rest of said validation unit.

* * * * *

UNITED STATES PATENT AND TRADEMARK OFFICE

CERTIFICATE OF CORRECTION

PATENT NO. : 5,054,787

DATED : October 8, 1991

INVENTOR(S) : John Richardson

It is certified that error appears in the above-identified patent and that said Letters Patent is hereby corrected as shown below:

TITLE PAGE

In the Abstract [57]:

At line 10, change "card" (first occurrence) to --handset--.

At line 10, change "card" (second occurrence) to --electronic handset--.

At line 19, change "BINGO card" to --handset--.

At line 23, change "BINGO card" to --electronic handset--.

At line 26, change "unti" to --unit--.

At column 1, line 7, change "820,458" to --820,245--.

At column 1, line 44, after "hours" insert --.--.

At column 2, line 15, change "hand sets" to --handsets--.

At column 2, line 25, change "hand sets" to --handsets--.

At column 2, line 33, change "hand set" to --handset--.

At column 2, line 62, change "gaming cards" to --handsets--.

At column 3, line 20, change "BINGO cards" to --handsets--.

At column 3, line 30, change "BINGO card" to --handset--.

At column 3, line 44, change "BINGO card" to --handset--.

UNITED STATES PATENT AND TRADEMARK OFFICE

CERTIFICATE OF CORRECTION

PATENT NO. : 5,054,787

DATED : October 8, 1991

INVENTOR(S) : John Richardson

It is certified that error appears in the above-identified patent and that said Letters Patent is hereby corrected as shown below:

At column 3, line 49, change "card" to --electronic handset--.

At column 3, line 60, change "BINGO cards" to --handsets--.

At column 3, line 60, after "on" insert --to--.

At column 4, lines 20-21, change "BINGO card" to --handset--.

At column 4, line 25, change "BINGO card" to --handset--.

At column 4, line 36, change "BINGO cards" to --handsets--.

At column 4, line 50, change "BINGO card" to --handset--.

At column 4, lines 59-60, change "BINGO" to --handsets--.

At column 5, line 50, change "plug" to --plugs--.

At column 5, line 61, after "of" (second occurrence) insert --an--.

At column 6, line 10, delete "(FIG.2C)".

At column 6, line 25, delete "the".

At column 6, line 61, after "grounded" insert --.--.

At column 7, line 14, after "signal" insert --.--.

At column 8, line 7, change "inputs" to --input--.

At column 9, line 15, delete "at 220".

At column 9, line 29, delete ";".

At column 9, line 30, delete ";".

At column 9, line 31, delete ";".

At column 9, line 32, delete ";".

UNITED STATES PATENT AND TRADEMARK OFFICE

CERTIFICATE OF CORRECTION

PATENT NO. : 5,054,787

DATED : October 8, 1991

INVENTOR(S) : John Richardson

It is certified that error appears in the above-identified patent and that said Letters Patent is hereby corrected as shown below:

At column 11, line 4, change "with" to --within--.

At column 11, line 53, after "levels" insert --.--.

At column 12, line 4, after "cleared" insert --.--.

At column 12, line 6, after "input" insert --.--.

At column 13, line 55, change "block" to --blocks--.

At column 14, line 53, change "BINGO card" to --handset--.

At column 16, line 28, change "104" to --A104--.

At column 16, line 59, change "handsets" to --handset's--.

At column 17, line 31, delete "card".

At column 17, line 34, after "byte" insert --commanding--.

At column 19, line 24, change "than" to --,then--.

At column 19, line 25, delete "that" (second occurrence).

At column 19, line 51, delete "new".

At column 19, line 60, after "electronic" insert --handset--.

At column 20, line 41 (claim 1), after "game" insert --,--.

At column 20, line 63 (claim 2), after "on" insert --a respective--.

At column 21, line 21 (claim 5), after "information" insert --to or download information--.

UNITED STATES PATENT AND TRADEMARK OFFICE

CERTIFICATE OF CORRECTION

PATENT NO. : 5,054,787

DATED : October 8, 1991

INVENTOR(S) : John Richardson

It is certified that error appears in the above-identified patent and that said Letters Patent is hereby corrected as shown below:

At column 21, line 27 (claim 6), after "upload" insert --information to said validation unit--.

At column 21, line 30 (claim 6), change "winding" to --winning--.

At column 21, line 49 (claim 7), change "co" to --codes;--.

Signed and Sealed this

Twenty-third Day of November, 1993

Bruce Lehman

*Attest:*

BRUCE LEHMAN

*Attesting Officer*

*Commissioner of Patents and Trademarks*